US006637337B2

(12) United States Patent
Hauck

(10) Patent No.: US 6,637,337 B2
(45) Date of Patent: Oct. 28, 2003

(54) METHOD FOR CONTROLLING THE TEMPERATURE OF PRINTING FORM SURFACES DURING PRINTING

(75) Inventor: Axel Hauck, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 47 days.

(21) Appl. No.: 09/935,620

(22) Filed: Aug. 23, 2001

(65) Prior Publication Data

US 2002/0023557 A1 Feb. 28, 2002

(30) Foreign Application Priority Data

Aug. 23, 2000 (DE) ..... 100 41 184

(51) Int. Cl.[7] ..... B41F 23/00
(52) U.S. Cl. ..... 101/487; 101/483
(58) Field of Search ..... 101/487, 483

(56) References Cited

U.S. PATENT DOCUMENTS 2,971,460 A * 2/1961 Shindle ..... 101/424.2
3,741,115 A * 6/1973 Keller ..... 101/148
4,712,475 A * 12/1987 Kemmerer et al. ..... 101/348
5,189,960 A * 3/1993 Valentini et al. ..... 101/487
5,218,905 A * 6/1993 Bolte et al. ..... 101/348
5,370,046 A * 12/1994 Spiegel et al. ..... 101/148
5,535,674 A * 7/1996 Vrotacoe et al. ..... 101/216
5,546,861 A * 8/1996 Loffler ..... 101/484
5,595,115 A * 1/1997 Rau et al. ..... 101/142
5,651,316 A * 7/1997 DeMoore et al. ..... 101/450.1
5,694,848 A 12/1997 Palmatier

FOREIGN PATENT DOCUMENTS

DE 29 51 436 A 1 7/1981
DE 40 00 912 C 1 5/1991
DE 41 08 883 A 1 9/1992
DE 44 29 520 A 1 2/1996
DE 198 57 107 A 1 6/2000
EP 0 611 648 A1 8/1994

* cited by examiner

*Primary Examiner*—Daniel J. Colilla
*Assistant Examiner*—Jill E Culler
(74) *Attorney, Agent, or Firm*—Laurence A. Greenberg; Werner H. Stemer; Gregory L. Mayback

(57) ABSTRACT

A method for controlling the temperature of print bearer surfaces during printing in rotary printing machines. The print bearers are fastened in exchangeable fashion on the circumferential surface of print form cylinders. The surfaces of the print bearers are inked by inking form rollers. The temperature of the color-separation-guiding surfaces of the print bearers is controlled in such a way that narrower/broader printing and/or shorter/longer printing arising during the passage of the printed material through the printing unit is compensated per individual printing unit.

7 Claims, 6 Drawing Sheets

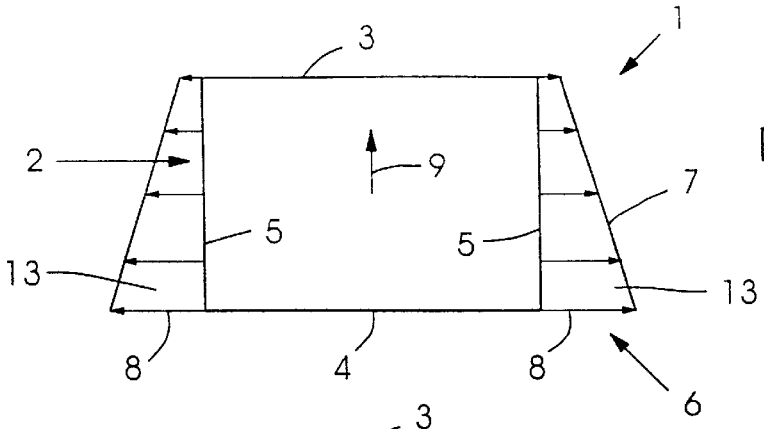
Fig.1.1
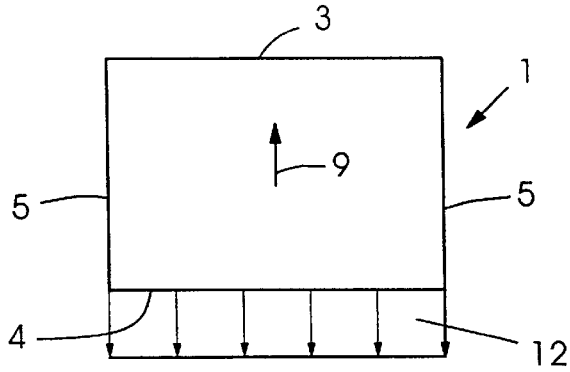
Fig.1.2
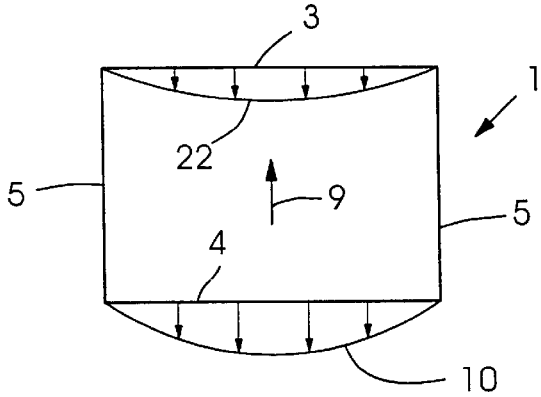
Fig.1.3
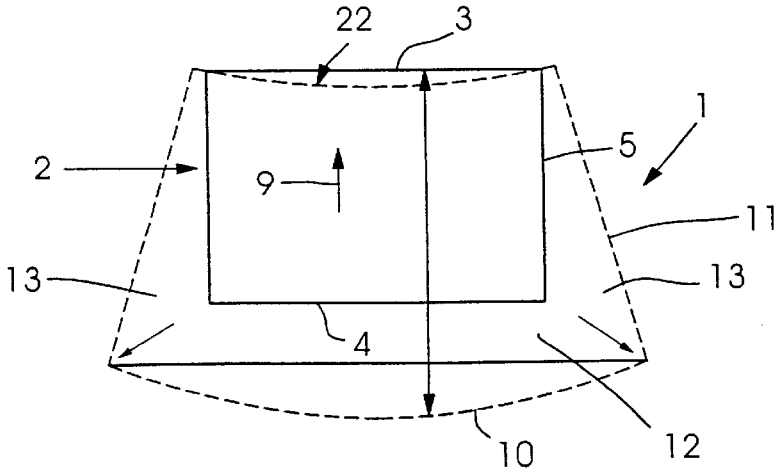
Fig.2

METHOD FOR CONTROLLING THE TEMPERATURE OF PRINTING FORM SURFACES DURING PRINTING

BACKGROUND OF THE INVENTION

FIELD OF THE INVENTION

The invention relates to a method for controlling the temperature of print bearing surfaces during printing in rotary printing machines.

During printing in a multicolor offset printing machine, in particular, a sheet-fed offset printing machine, a plurality of phenomena are known that affect the position or the geometry of the printed images of the individual color separations, i.e., the color separations for black, magenta, cyan, and yellow, from which the printed image is composed. As a result of these phenomena, the register of the individual color separations, from whose superposed printing, the printed image arises, can no longer be set correctly on the overall sheet.

Round printing manifests itself for example as a deviation of shape in the printed images of different separations, resulting, in particular, as curvatures of lines running transverse to the direction of printing.

In addition, narrower/broader printing describes the differences in the print widths, seen over the sheet length. Given an increase of this effect in the print direction, the deviation of the print widths is generally greatest at the rear edge of the sheet. In the rear printing units, in relation to the direction of sheet travel, of a series printing machine, there is a tendency for printing to be narrower in comparison with the color separation of the first printing unit.

The phenomenon of shorter/longer printing designates the differences in the print length. Because the front edge of the sheet is adjusted so as to fit precisely, this effect is likewise seen in registration differences with an increasing tendency in the direction towards the rear edge of the sheet. In comparison with the color print from the first printing unit, in general, printing is shorter in the rear printing units as seen in the direction of sheet travel.

Given printed material that is approximately 135 g/m$^2$, and that passes through four successive printing units, the deviation in registration caused by the three stated phenomena lies in the range of up to half a screen frequency, and causes color displacements in multicolored screen surfaces that are clearly perceptible in the print. In addition, losses of print quality with respect to depth of detail and delineation are known, or are to be feared. With the increasing use of CtP (computer-to-plate) apparatuses, a worsening of the problem can be expected. Given precisely registered printing forms, the time that is saved with CtP will be more than offset by the time required for manual corrections of each color separation.

The causes of the positional deviations or of the geometric deviations that occur are of very widely varying types. The absorption of dampening solution by the sheet during its passage through the respective print gap or nip contributes decisively to the deformation of the sheet during the passage through the individual print units. In addition, the print pressure set in the print gap plays a further significant role. The tack of the ink transferred onto the surface of the blanket can likewise result in a significant deformation of the sheet during its passage through the print units.

Grippers that are arranged centrically over the width of the printing unit, and that guide the sheet at the circumferential surface of cylinders or drums, can locally loose hold of the sheet. This results in a non-flat seating of the sheet on the surface of the cylinder that guides the sheet, for example the counter-pressure or impression cylinder of a printing unit. Under the pressure prevailing in the print gap, a rolling out of this deformation that arises takes place in the respective sheets to be printed. Mechanical deformations, such as for example, cylinder deflection of the cylinder that guides the paper between the side walls of the printing units, as well as winding differences in the individual printing unit cylinders, can also be significant.

Further influencing factors can include: the format to be printed, the rigidity of the paper-guiding cylinder, the number of successive printing units, as well as the position of the drive. Whether the rotary printing machine uses a perfecter is also an influencing factor. Finally, the printing speed is a factor that influences the sheet: deformation.

Regarding the printing material, significant factors include the density of the printing material, its porosity, the direction of travel, and whether the material is long grain or short grain. Furthermore, the water absorption characteristic, which has a striking influence on the deformation, plays a considerable role. The subject to be printed, the surface covering, and the respective level of coloration should also be mentioned. Besides the tack of the ink, other important factors include the separation behavior of the printed material from the respective ink-bearing surface of the blanket cylinder, as well as the setting of the pressure and of the dampening, of the respective printing unit.

Up to now, it has been attempted to counteract these phenomena by reinforcing the cylinders in the printing units of the sheet-processing printing machine against deflection. In addition, the plate and impression cylinders were previously classified into various diameter tolerances, and were constructed so that the diameter of the impression cylinders in the rear printing units had a tendency to increase, while the diameter of the respective plate cylinders decreased in the direction towards the rear printing units.

In straight-printing and perfecting-printing machines, cylinder jackets in corresponding gradations have also been used. In case of problems during the printing job, the jackets are replaced, or are simply exchanged at the respective cylinders. An attempt has been made to compensate for a shorter printing by using calibrated underlay sheets under the printing plates. In addition, it has been attempted, at considerable expense, to deform the print plates at the rear edge in the circumferential and lateral direction on the respective print form cylinder, through their mounting.

SUMMARY OF THE INVENTION

It is accordingly an object of the invention to provide a method for influencing the geometry of a print bearer that is held on a print form cylinder of a multicolor rotary printing machine which overcomes the above-mentioned disadvantageous of the prior art apparatus and methods of this general type.

With the foregoing and other objects in view there is provided, in accordance with the invention, a method for controlling the temperature of print bearing surfaces during printing in a rotary printing machine, that includes steps of: providing a plurality of printing units having printing form cylinders with circumferential surfaces; in each one of the plurality of the printing units, exchangeably fastening a print bearer on a respective one of the circumferential surfaces of the print form cylinders; in each one of the plurality of the printing units, using at least one inking form roller to ink the respective print bearer; and in each one of the plurality of the printing units, during printing, controlling a temperature of a color separation-guiding surface of the respective print bearer to compensate for a printing effect selected from the group consisting of narrower/broader printing and shorter/longer printing that respectively arises during passage of printed material in the one of the plurality of the printing units.

In other words, the temperature of the print bearer surfaces are controlled during printing in rotary printing machines in which the print bearers are fastened in an exchangeable fashion on the circumferential surfaces of print form cylinders, and the print bearers are inked via inking form rollers. The temperature of the surfaces of the print bearers guiding the color separations can be controlled in each individual printing unit, for compensating for narrower/broader printing and/or for shorter/longer printing that arises respectively during the passage of the printed material in the individual printing unit.

The advantages resulting from the solution enables, in real time during the printing process, the print length and print width to be individually influenced per individual printing unit of a rotary printing machine. Manual adjustments that were previously carried out according to the skill and professional experience of the printer at the sheet compensators for the correction of round and narrow printing can now be entirely omitted by controlling the temperature of the print bearer surfaces. Controlling the temperature, individually per printing unit, of the color separations located on the surfaces of the print bearers, can on the one hand take place on the upper side thereof, via a corresponding controlling of the temperature of the inking form rollers and of the dampening form roller, or of the inking unit, as well as from the underside of the printing forms via a corresponding controlling of the temperature of the cylinder jacket surface. With this procedure, a temperature profile can be produced at the printing form surface, which because the expansion characteristic of the printing form surface is independent of direction, permits both an elongation of the printing form, and seen in the direction of print rolling, a broadening of the printing form.

In accordance with an added feature of the invention, a uniform temperature or a printing system temperature can be set economically by controlling the temperature of the ink-bearing inking form rollers.

In addition to controlling the temperature of the print form surface that guides the color separations, the temperature of the print form cylinders that respectively receive the print bearers on their circumferential surfaces can be controlled, for example, via a an external heat supply.

Controlling the temperature of the print form surface via a temperature profile that can be predetermined at the jacket surface of the print form cylinder at the underside of the printing form allows the predetermination of the temperature level, and also the distribution of temperature, in the circumferential direction and/or lateral direction of the printing form, individually per printing unit.

As a rule, print bearers or printing forms made of aluminum have a coefficient of thermal expansion of approximately 24 $\mu$m/mK, and therefore react fairly sensitively to changes in temperature, which can be exploited in order to produce direction-independent changes in elongation at the print bearer. The temperature in the transition region at the surface of the color separation of the print bearer can be set in the range between 10° C. and 60° C., in which range it is possible to achieve particularly advantageous pressure and ink transfer characteristics. If the method is used in rotary printing machines in which a plurality of individual printing units are arranged one after the other in series, then, given a constant temperature of the printing form per individual printing unit and the concomitant enlargement of the print form surface, with exploitation of the tendency towards narrow printing in the rear printing units of a multicolor rotary machine, the effects of the shorter/longer printing and of the narrower/broader printing can be simultaneously compensated.

Other features which are considered as characteristic for the invention are set forth in the appended claims.

Although the invention is illustrated and described herein as embodied in a method for controlling the temperature of printing form surfaces during printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

FIGS. 1.1 to 1.3 show a color separation in the ideal state and a superposed color separation with deformations due to narrower/broader printing, shorter/longer printing, and round printing;

FIG. 2 shows a color separation with superposed positional deviations corresponding to the deformations from FIGS. 1.1–1.3;

DESCRIPTION OF THE PREFERRED EMBODIMENTS

Figure 3A:
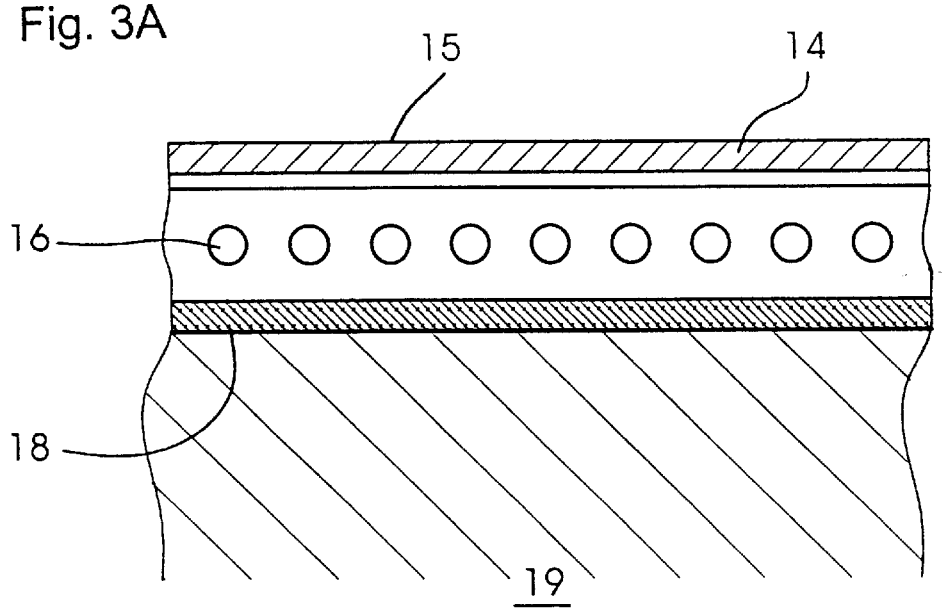
FIG. 3*a* shows a temperature control device integrated into a cylinder body.

Referring now to the figures of the drawing in detail and first, particularly, to FIGS. 1.1–1.3 thereof, there is shown a color separation on the surface of a print bearer in the ideal state, and a color separation in the deformed states described above.

In the ideal state 2 of the printed sheet 1, this sheet has a front edge 3 that runs strictly horizontally, and oriented precisely at a 90° angle thereto, side edges 5. In the ideal state 2, rear edge 4 also runs perpendicular to side edges 5, which run perpendicular to the front edge 3. In the ideal state 2, the width of printed sheet 1 at the front edge 3 and at the rear edge 4 is exactly equal. A deformed printed sheet, essentially including a trapezoidal deformation 6 (FIG. 1.1), is superposed in the printed sheet 1, which includes the ideal shape or state 2. The printed sheet 1 in the ideal state 2 and the deformed printed sheet have a common front edge 3, which runs horizontally in the view shown in FIG. 1.1. Deviating from the ideal state 2 of the printed sheet 1, the side edges 5 run in a broadening fashion towards the rear edge 8 of the sheet. In comparison with an undeformed sheet rear edge 4, the rear edge of the sheet includes a broadened print width 8. This results in an enlarged sheet surface of the trapezoidally deformed sheet, in comparison with the printed sheet 1, which reproduces ideal state 2. The surface increase at the rear region of trapezoidally deformed printed sheet 1 is designated with reference character 7.

In the view shown in FIG. 2, a printed sheet is reproduced having a superposed positional deviation caused by the effects of round printing, shorter/longer printing, and narrower/broader printing.

From the representation shown in FIG. 2, it can be seen that the sheet moving in the sheet direction of travel 9 through the print gap of the individual printing unit (represented by the illuminated surface of a print bearer) takes on, during the printing process, a shape indicated by the broken color separation boundary. In the ideal state 2 of the printed sheet 1, side edges 5, as well as the front edge 3 and the rear edge 4, are located in a rectangular configuration, situated at right angles to one another. In contrast, in the deformed state of the printed sheet, the side edges, which originally ran strictly vertically, take on a slightly rounded curve 11, and run out into a rounded rear edge 10, shown in a broken representation according to FIG. 2. Front edge 3, which runs horizontally in the ideal state, can also take on a rounded configuration, shown in a broken representation and is designated with reference character 22. The deformation of the printed sheet, indicated by the broken representation shown in FIG. 2, results in an increase in length 12 of the sheet, as well as in an increase in the surface 13 that occurs in the rear region of the printed sheet, in particular with respect to the print width.

Figure 3B:
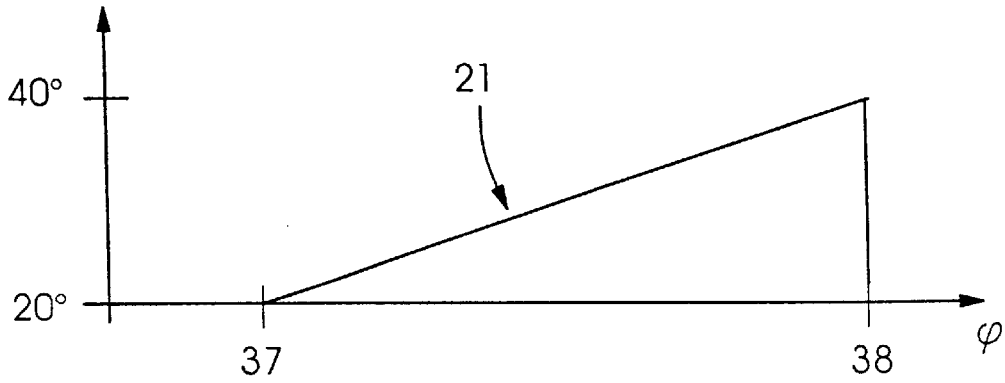
FIG. 3*b* shows a temperature profile that is impressed in the circumferential direction.

FIG. 3*a* shows a temperature control device that is integrated into a cylindrical body and FIG. 3*b* shows a temperature profile that can be impressed in the circumferential direction.

According to the representation shown in FIG. 3*a,* a cylinder for a print bearer or form 14, with a color separation 15 held on the surface thereof, can be provided with temperature control elements 16 inside its cylinder body 19. The temperature control elements 16 can extend from the end surfaces of a channel 36 in the circumferential direction of the jacket surface 18 of the cylinder body 19, and can produce a temperature profile 21 that arises in the circumferential direction as shown in FIG. 3*b*. In a first approximation, the temperature profile 21 can assume a linear curve, characterized by a gradual increase in the temperature from the front edge 37 of the printing form to the rear edge 38 of the printing form. The temperature level that is impressed on a printing form 14 or 35 (FIG. 4) is preferably located in the range between 20° and 40° C. If, in the individual printing units, the print bearers are at different temperatures, different print lengths and print widths will arise in the individual printing units on the basis of the temperature differences. Besides the temperature differences, temperature profiles 21 as shown in FIG. 3*b* can also be produced. The temperatures of the individual printing units should be selected such that the effects of the shorter/longer printing and of the narrower/broader printing are compensated to the greatest possible extent. Because the elongation effect of the print bearer is direction-independent, the temperature will act uniformly for the transverse direction and the longitudinal direction. Since multicolor rotary printing machines tend to print shorter and narrower in the rear printing units, these effects can be compensated in the rear printing units with an enlargement of the print bearer with respect to the length and width extension of the printing form, through the production of higher temperatures.

Figure 4:
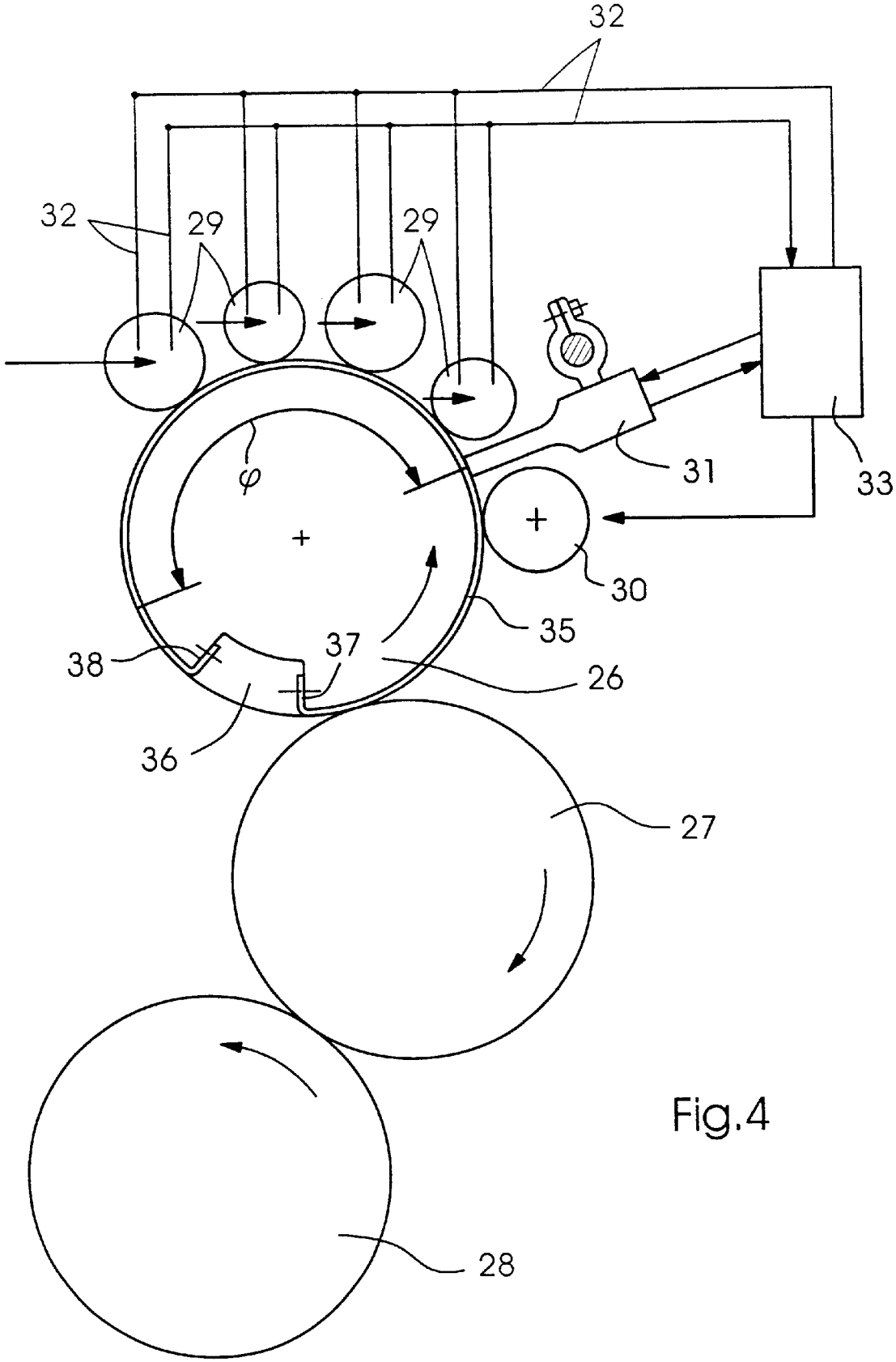
FIG. 4 shows the side view of an inking unit that inks the print bearer surface.

FIG. 4 shows a side view of an inking unit that simultaneously inks and controls the temperature of the print bearer surface. A print bearer or form 35 is held on a printing form cylinder 26 of an individual printing unit of a multicolor rotary machine. The front edge 37 or the rear edge 38 of the print bearer is held in a channel 36 by clamping devices that are provided but that are not shown in more detail here. The print form cylinder 26 rotates counterclockwise, in the direction of the arrow. A plurality of inking form rollers 29 having various diameters are allocated to print form cylinder 26. The rollers 29 are adjustable to various jacket temperatures via temperature control fluid supply lines 32. The temperature of the surface of the print form 35 is scanned using a temperature sensor 31, whose temperature values are communicated to a control device 33. Using control device 33, the temperature of temperature control fluid that is supplied to the hollow spaces of inking form rollers 29 can be set. In addition, the dampening roller 30, the temperature, and the application of moisture by the dampening roller 30 can also be controlled using the control device 33. With the controlling of the temperatures of the inking unit, a uniform temperature can be set at the transition region to the surface of the print form 35. A controlling of the temperature of the surface of the print form 35 is automatically followed by an adaptation of the moisture by the dampening roller 30, controlled by control device 33.

Using the configuration shown in FIG. 4, a uniform temperature can be set on the surface of the print form 35, because the print form cylinder, and therefore the print form temperature, follows the inking unit temperature, even though there might be a slight time delay. In a multicolor rotary printing machine, in the context of controlling the temperature of an individual printing unit, a preselection of different temperature control fluid temperatures, as well as the presetting of different cooling tasks at inking form rollers and ink distributors, is carried out via the control device 33. The inking unit temperature range in which good printing results can still be achieved is located between 10° C. and 60° C. The temperature of the print form cylinder 26 is somewhat lower. The inked print image is transferred from the surface of the print form 35 holding the color print or separation 15 and onto the surface of a packing, usually a rubber blanket of a transfer cylinder 27. From which, there takes place a transfer of the printed image onto the surface of the printed material, which surface passes through the print gap between the transfer cylinder 27 and the counter-pressure cylinder 28.

Figure 5:
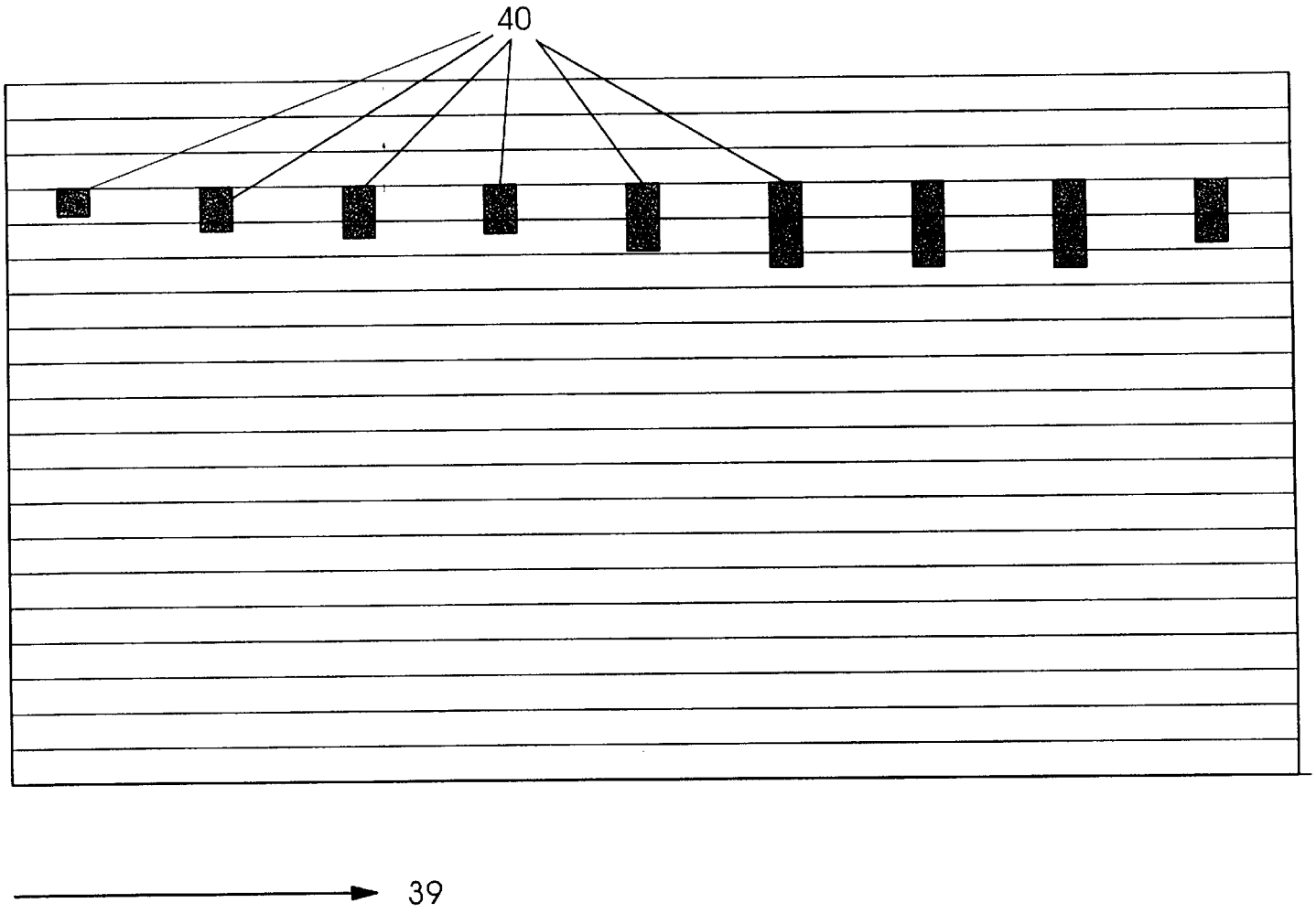
FIG. 5 shows the deformations that occur, in the passage of a plurality of printing units, of the color separation front edge, seen transverse to the printing direction over the printing unit sequence of a multicolor rotary machine.

FIG. 5 shows the deformations of the side edges of the color separation transverse to the direction of printing, which arise during the passage through a plurality of printing units, and which are plotted over the printing unit sequence. In a multicolor rotary printing machine, seen over the printing unit sequence 39, only slight deformations 40 arise at the respective front edge (designated here with reference character 40). Seen over the printing unit sequence 39, these deformations remain constant in a region, with a slight increasing tendency towards the center of the machine, and then decrease continuously towards the end of the print run.

Figure 6:
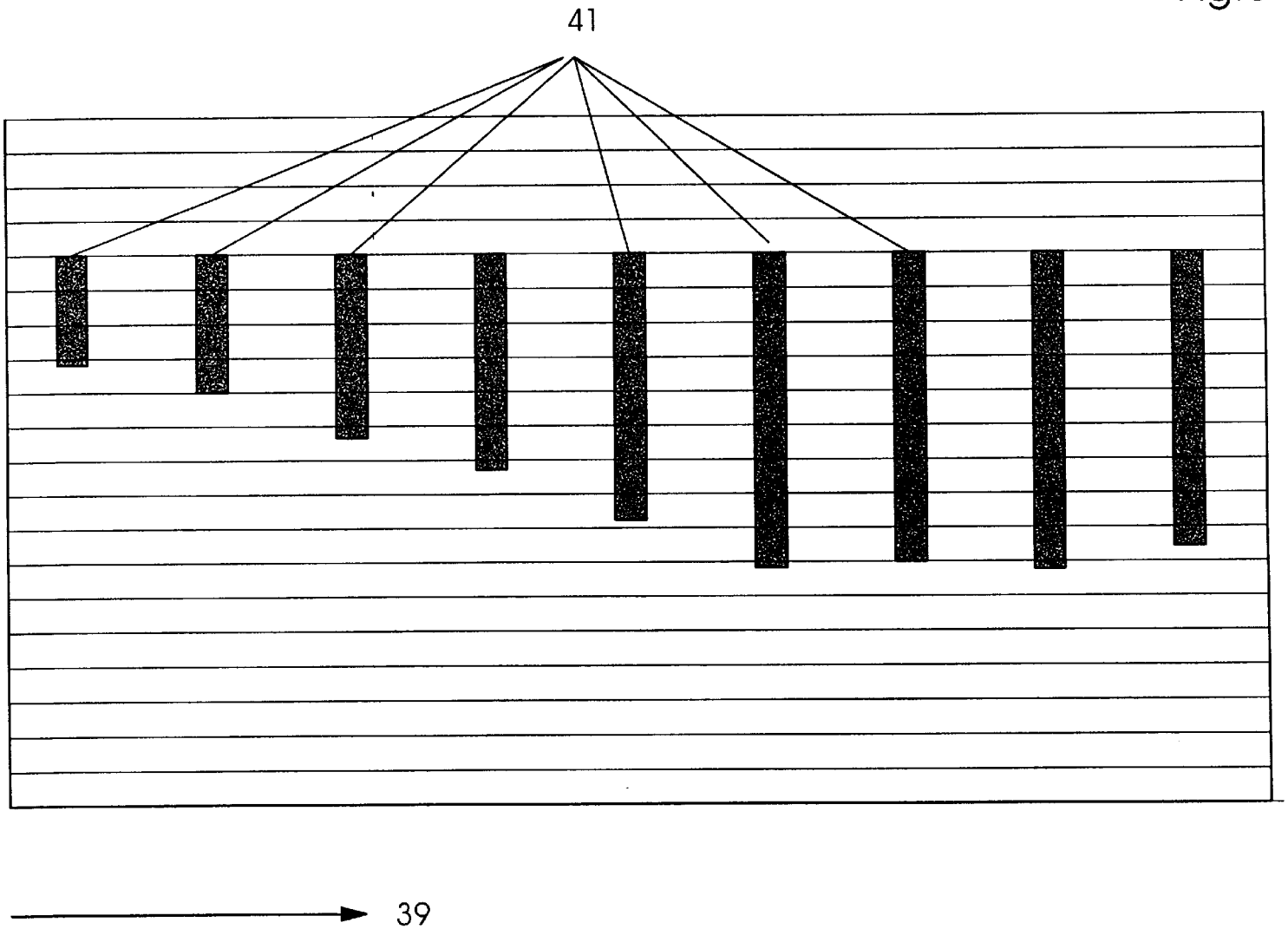
FIG. 6 shows the curve of the narrow printing of the rear edge of the color separations over the printing unit sequence of a multicolor rotary printing machine.

In contrast FIG. 6 shows the curves of the narrower printing at the rear edges of the color separations, which are plotted over the printing unit sequence 39. From this representation, it can be seen that the deformations in the first printing units of the multicolor rotation lie higher than at the front edge of the sheet, and increase significantly upon further passage of the printed material through the rotary printing machine, with an increasing tendency. This reflects the trapezoidal deformation of the printed material that occurs in the passage through the print gaps between the transfer cylinder 27 and the counter-pressure cylinder 28 through the printing units.

Figure 7:
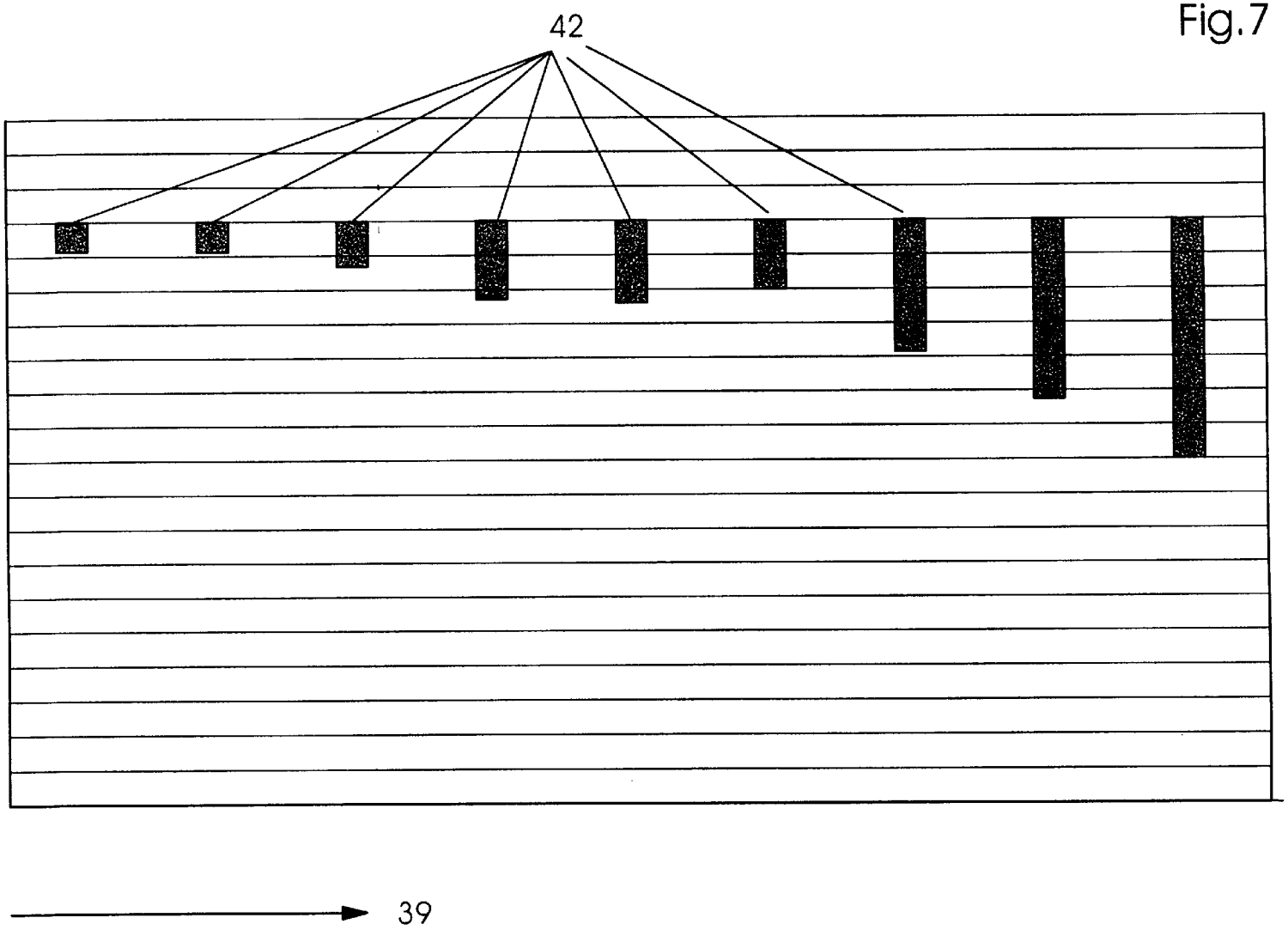
FIG. 7 shows the curve of the resulting shorter/longer printing over the number of printing units of a multicolor rotary printing machine.

FIG. 7 shows how the effect of the shorter/longer printing takes effect over the printing unit sequence 39 of a multicolor rotary machine, as seen over all of the printing units. The increase in length, designated with reference character 42, seen in the circumferential direction of the cylinder or seen in the longitudinal extension of the printed material, remains approximately constant in the first half of the machine, and then assumes higher values in the second printing machine section of a multicolor rotary printing machine. While the narrower/broader printing shown in FIG. 6 essentially takes effect over the print width, shorter or longer printing shown in FIG. 7 takes effect in the longitudinal direction of the print, or in the circumferential direction of the print form cylinder 26. Controlling the temperature of the print form 35, which holds the color separations 15, in the rear printing units of a multicolor rotary machine effects a direction-independent expansion, seen in the direction of the width and in the direction of the length of the printing form. The shape deviations that occur as shown in FIG. 6 and in FIG. 7 in the second section of the machine can be effectively countered via the temperature controlling.

I claim:

1. A method for controlling the temperature of print carrying surfaces during printing in a rotary printing machine, which comprises:

providing at least one printing unit having a print form cylinder with a circumferential surface;

exchangeably fastening a print carrier on the circumferential surface of the print form cylinder;

using at least one inking form roller to ink the print carrier;

providing a targeted linear deformation of the print carrier; and during printing, controlling a temperature of a color separation-guiding surface of the print carrier to produce said targeted linear deformation to compensate for at least one printing effect selected from the group consisting of narrower/broader printing and shorter/longer printing that respectively arises during passage of printed material in each of the at least one printing unit.

2. The method according to claim 1, which further comprises using the at least one inking form roller to perform the temperature controlling step and to thereby produce a uniform temperature on the circumferential surface of the print form cylinder.

3. The method according to claim 1, which further comprises:

providing the circumferential surface as a cylinder jacket surface; and impressing a temperature profile with the cylinder jacket surface.

4. The method according to claim 1, which further comprises supplying heat to the circumferential surface of the print form cylinder from outside of the print form cylinder.

5. The method according to claim 1, which further comprises maintaining a temperature on the surface of the print carrier in a range from 10° to 60° C.

6. The method according to claim 1, which further comprises impressing a two-dimensional temperature distribution on the print form cylinder.

7. The method according to claim 1, which further comprises constantly performing the temperature controlling step for compensating for the narrower/broader printing and shorter/longer printing along the at least one printing unit.

* * * * *